US009579902B1

(12) United States Patent
Olson et al.

(10) Patent No.: US 9,579,902 B1
(45) Date of Patent: Feb. 28, 2017

(54) CASCADING RESERVOIRS FOR SOLID-INK PRINTERS

(71) Applicant: XEROX CORPORATION, Norwalk, CT (US)

(72) Inventors: Steven Olson, Penfield, NY (US); Christopher Douglas Atwood, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/044,314

(22) Filed: Feb. 16, 2016

(51) Int. Cl.
*B41J 2/175* (2006.01)

(52) U.S. Cl.
CPC ..... *B41J 2/17593* (2013.01); *B41J 2/17596* (2013.01)

(58) Field of Classification Search
CPC .... B41J 2/175; B41J 2/17506; B41J 2/17513; B41J 2/17593; B41J 2/17596
See application file for complete search history.

(56) References Cited

U.S. PATENT DOCUMENTS 6,520,630 B1 * 2/2003 Oda ..... B41J 2/17503 347/85
7,178,910 B2 * 2/2007 Suzuki ..... B41J 2/175 347/85
8,079,691 B2 * 12/2011 Koehler ..... B41J 2/17509 347/84
8,313,183 B2 * 11/2012 Platt ..... B41J 2/17593 347/88

* cited by examiner

*Primary Examiner* — Anh T. N. Vo
(74) *Attorney, Agent, or Firm* — MH2 Technology Law Group LLP

(57) ABSTRACT

A reservoir in a printer includes a body that includes a first inlet and a first outlet. The body defines an internal volume positioned between the first inlet and the first outlet. A valve is positioned within the body. Ink flows from the first inlet, through the valve, and into the internal volume when the valve is in an open position, and the ink is prevented from flowing through the valve and into the internal volume when the valve is in a closed position. The ink is configured to flow from the internal volume, through the first outlet, and into a printhead. A heater is positioned within the body, and the heater is configured to heat the ink.

17 Claims, 5 Drawing Sheets

CASCADING RESERVOIRS FOR SOLID-INK PRINTERS

TECHNICAL FIELD

The present teachings relate generally to external ink reservoirs for printers and, more particularly, to systems and methods for supplying heated ink from an external reservoir to a printhead.

BACKGROUND

Solid-ink printers use solid ink sticks or pellets (e.g., spheres) instead of fluid ink or toner powder. Some solid-ink printers include a reservoir positioned within a printhead. These (internal) reservoirs are coupled to the printheads via screws, bolts, welding, or the like, which makes the printheads larger and more expensive. However, more recent solid-ink printers have printheads without an internal reservoir and thus require an external reservoir for receiving the solid ink. The solid ink is loaded into a melter, which melts the ink to produce a heated, liquid ink. The heated, liquid ink is then transported to the external reservoir, and subsequently distributed to the printheads to produce images on paper. What is needed is an improved external reservoir for supplying heated ink to a printhead.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A reservoir in a printer is disclosed. The reservoir includes a body that includes a first inlet and a first outlet. The body defines an internal volume positioned between the first inlet and the first outlet. A valve is positioned within the body. Ink flows from the first inlet, through the valve, and into the internal volume when the valve is in an open position, and the ink is prevented from flowing through the valve and into the internal volume when the valve is in a closed position. The ink is configured to flow from the internal volume, through the first outlet, and into a printhead. A heater is positioned within the body, and the heater is configured to heat the ink.

A solid-ink printer is also disclosed. The printer includes a melter configured to heat an ink to produce a liquid ink. The printer also includes a first reservoir and a second reservoir. The first reservoir includes a lid and a base. The lid includes a first inlet configured to receive the liquid ink from the melter. The lid also includes a first outlet. The base includes a second outlet. The first reservoir also includes a valve. A first portion of the liquid ink flows from the first inlet, through the valve, and into an internal volume defined by the base when the valve is in an open position, and the first portion of the liquid ink is prevented from flowing through the valve and into the internal volume when the valve is in a closed position. A first heater is positioned within the lid. The second reservoir also includes a lid and a base. The lid of the second reservoir includes a first inlet configured to receive a second portion of the liquid ink from the first reservoir. The second portion of the liquid ink flows from the first outlet of the first reservoir, through a tube, and into the first inlet of the second reservoir. The lid of the second reservoir also includes a first outlet. The base of the second reservoir includes a second outlet. A valve is positioned within the second reservoir. The second portion of the liquid ink is configured to flow from the first inlet of the second reservoir, through the valve of the second reservoir, and into an internal volume of the second reservoir when the valve is in an open position, and wherein the second portion of the liquid ink is prevented from flowing through the valve of the second reservoir and into the internal volume of the second reservoir when the valve is in a closed position. A first heater positioned within the lid of the second reservoir. The printer also includes first and second printheads. The first portion of the liquid ink is configured to flow from the internal volume of the first reservoir, through the second outlet of the first reservoir, and to the first printhead. The second portion of the liquid ink is configured to flow from the internal volume of the second reservoir, through the second outlet of the second reservoir, and to the second printhead.

A method for supplying ink to one or more printheads is also disclosed. The method includes melting solid ink in a melter to produce liquid ink. The liquid ink flows from the melter into a first reservoir. A valve in the first reservoir is actuated into an open position, allowing a first portion of the liquid ink to flow through the valve of the first reservoir and into an internal volume of the first reservoir. The first portion of the liquid ink then flows from the internal volume of the first reservoir, through a first outlet of the first reservoir, and into a first printhead. A valve in a second reservoir is actuated into an open position, allowing a second portion of the liquid ink to flow through the valve of the second reservoir and into an internal volume of the second reservoir. The second portion of the liquid ink then flows from the internal volume of the second reservoir, through an outlet of the second reservoir, and into a second printhead.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same, similar, or like parts.

Figure 1:
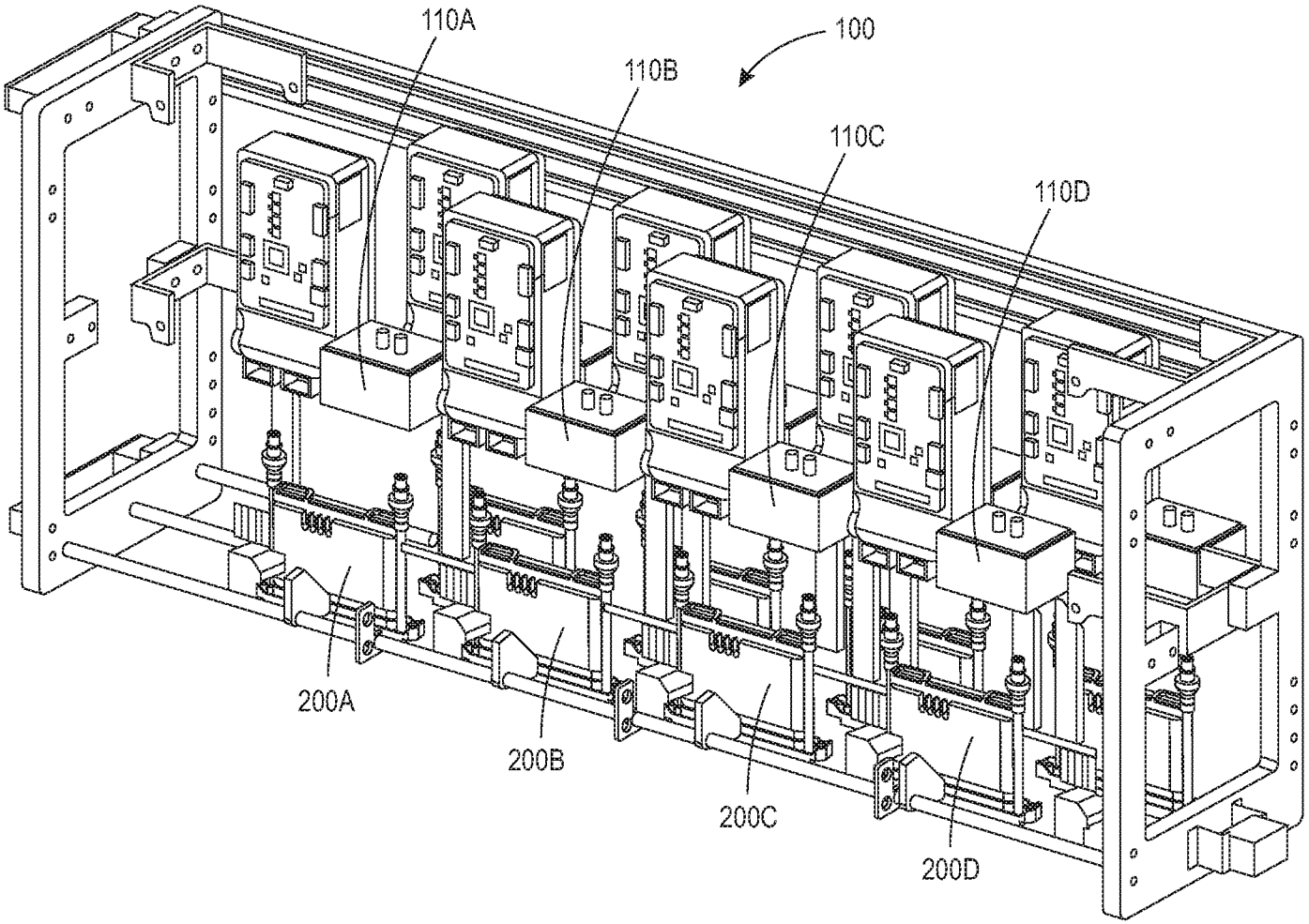
FIG. 1 depicts a perspective view of a portion of a printer, according to an embodiment.

FIG. 1 depicts a perspective view of a portion of a printer 100, according to an embodiment. The printer 100 may include one or more reservoirs (four are shown: 110A-D)

and one or more printheads (four are shown: 200A-D). As shown, the reservoirs 110A-D may be external to the printheads 200A-D. The reservoirs 110A-D may be coupled to the printheads 200A-D only via heated tubes that provide ink from the reservoirs 110A-D to the printheads 200A-D, as discussed below. The reservoirs 110A-D may not be coupled to the printheads 200A-D via bolts, screws, adhesive, welding, or the like. The ink may be solid ink or any other ink (e.g., UV ink) that is heated before being introduced into a printhead 200A-D.

By designing the printer 100 (e.g., the reservoirs 110A-D and printheads 200A-D) to fit one reservoir per printhead if needed, this allows easy transformation to a two-color configuration within the printer 100 (i.e., for future expansion). This may be accomplished by adding a reservoir with a different color and linking it to the same two printheads 200A-D supported by the existing reservoir 110A-D with the first color. Having two outlets on the reservoir 110A-D and making space on the print bar may enable this ability. As such, FIG. 1 shows one reservoir 110A-D per printhead 200A-D even though with a one-color printhead 200A-D, only half this many reservoirs 110A-D are needed.

Figure 2:
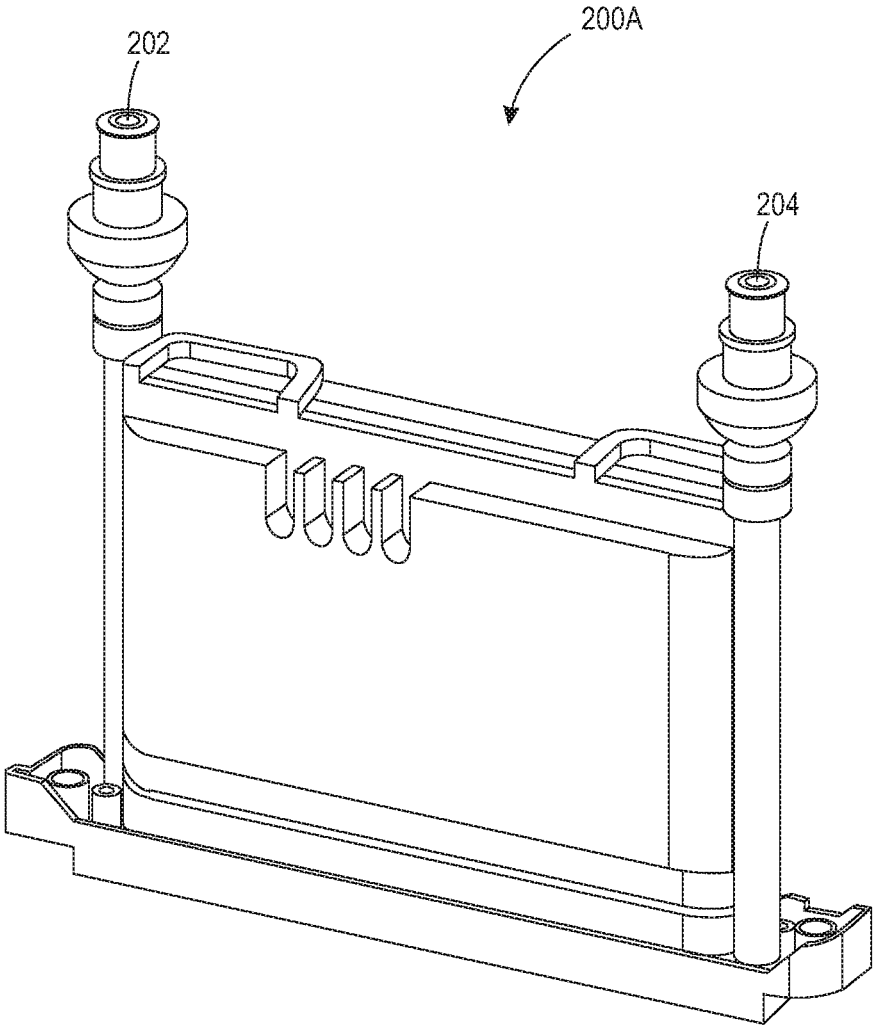
FIG. 2 depicts a perspective view of a printhead (without an internal reservoir) in the printer, according to an embodiment.

FIG. 2 depicts a perspective view of one of the printheads 200A, according to an embodiment. As shown, the printhead 200A may include one or more inlets (two are shown: 202, 204). The inlets 202, 204 may be or include (or be coupled to) heated tubes, as discussed below.

Figure 3:
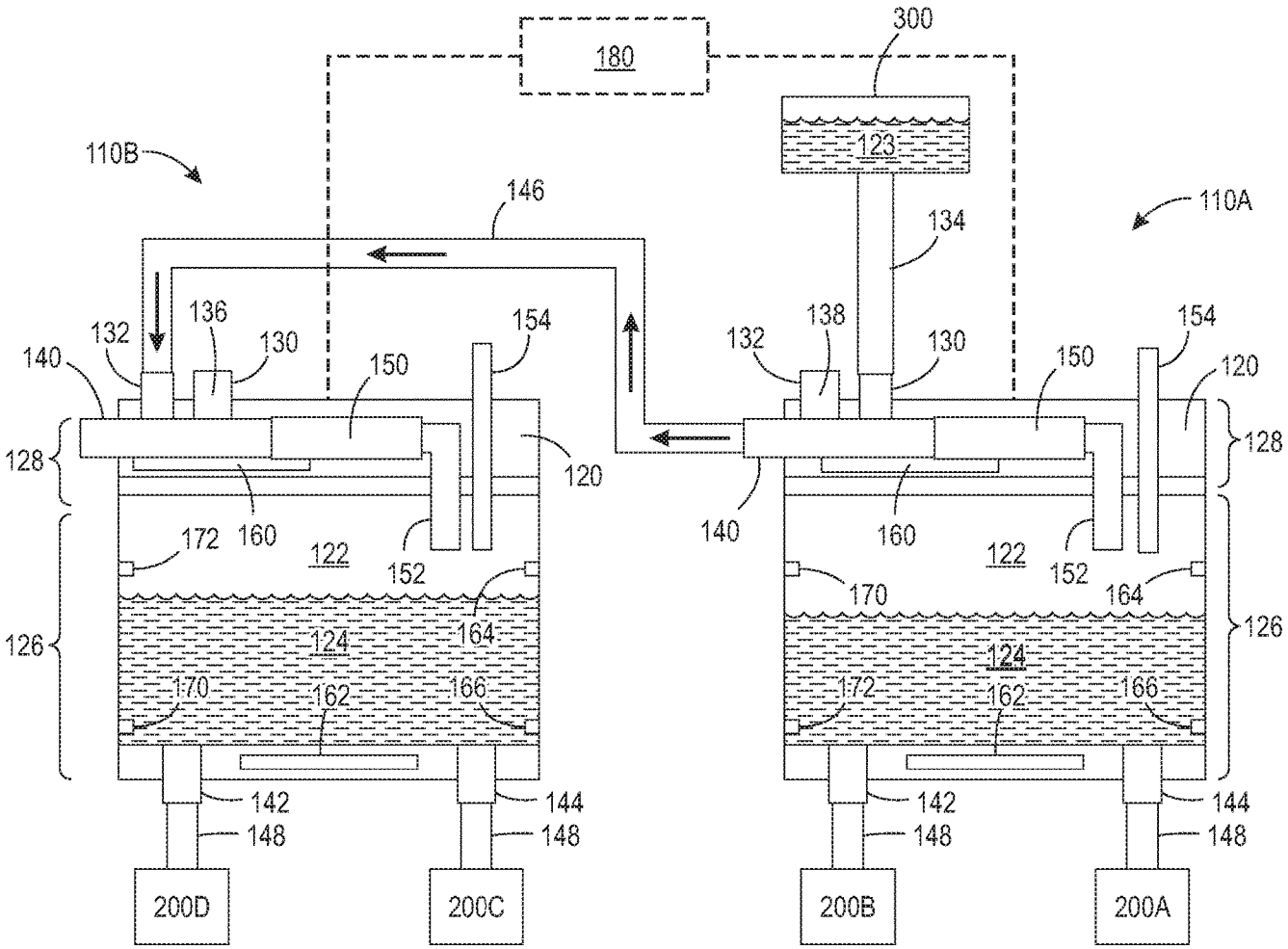
FIG. 3 depicts a cross-sectional side view of two reservoirs in the printer, according an embodiment.

FIG. 3 depicts a cross-sectional side view of two of the reservoirs 110A, 110B in the printer 100, according an embodiment. The reservoirs 110A, 110B may each include a body 120 defining an internal volume 122 in which ink 124 may be stored. The body 120 may be made of a metal, such as aluminum. The body 120 may include a base 126 and a lid 128. A seal may be positioned between the base 126 and the lid 128.

Reference numbers 123 and 124 are both used to identify the ink in this disclosure. Reference number 123 refers to the ink when the ink is pressurized. The ink may be pressurized before the ink flows through one of the valves 150. After the ink flows through one of the valves 150, the ink is "unpressurized" and designated with reference number 124.

Each body 120 may each include one or more ink inlets (two are shown: 130, 132). As shown, the inlets 130, 132 may be coupled to the lid 128 of the body 120. The first inlet 130 of the first reservoir 110A may be coupled to and in fluid communication with a melter 300 in the printer 100. As shown, a heated umbilical tube 134 may provide the path of fluid communication between the melter 300 and the first inlet 130 of the first reservoir 110A. The first inlet 130 of the second reservoir 110B may be sealed with a plug 136; however, in other embodiments, the first inlet 130 of the second reservoir 110B may be coupled to and in fluid communication with the melter 300.

As the first reservoir 110A may receive ink 123 through the first inlet 130, the second inlet 132 may be sealed with a plug 138. The second inlet 132 of the second reservoir 110B may be coupled to and in fluid communication with an outlet 140 of the first reservoir 110A. As such, a portion of the ink 123 in the first reservoir 110A may flow out of the outlet 140 of the first reservoir 110A, through a heated tube 146, and into the second reservoir 110B through the second inlet 132. This may form a "cascaded" configuration where the ink 123 may flow between two (or more) reservoirs 110A, B. The plugs 136, 138 may be inserted into one of the inlets 130, 132, which may allow the reservoirs 110A, 110B to be positioned anywhere in the cascaded configuration (e.g., chain) of reservoirs. The tube 146 between the reservoirs 110A, 110B may be shorter than having a second heated umbilical 134 extending from the melter 300 to the second reservoir 110B.

Each body 120 may also include one or more ink outlets (three are shown: 140, 142, 144). As shown, the first outlet 140 may be coupled to the lid 128 of the body 120, and the second and third outlets 142, 144 may be coupled to the base 126 of the body 120. The first outlet 140 of the first reservoir 110A has been discussed above (i.e., it may be used to supply ink 123 from the first reservoir 110A to the second reservoir 110B). Although not shown, the first outlet 140 of the second reservoir 110B may similarly be coupled to and in fluid communication with an inlet of a third reservoir. Alternatively, it may be sealed with a plug (e.g., if it is the last reservoir in the chain). The second and third outlets 142, 144 of the first and second reservoirs 110A, B may be coupled to and in fluid communication with one or more printheads 200A-D (see FIG. 1). As shown, heated tubes 148 may provide the path of fluid communication from the outlets 142, 144 of the reservoirs 110A, B and the printheads 200A-D. One of the outlets 142, 144 may be sealed with a plug when the reservoirs 110A, 110B are only coupled to a single printhead 200A-D.

A valve 150 may be positioned within each body 120. More particularly, the valve 150 may be positioned within the lid 128 of the body 120. One side of the valve 150 may be in fluid communication with the first inlet 130, the second inlet 132, the first outlet 140, or a combination thereof. The second side of the valve 150 may be in fluid communication with the internal volume 122. In another embodiment, the valve 150 may be positioned at least partially in the base 126 and in the lid 128. In this embodiment, the valve 150 may be positioned on the side of the internal volume 122. As shown, a channel 152 may provide the path of fluid communication between the valve 150 and the internal volume 122. The valve 150 may be actuated between a first (e.g., open) position and a second (e.g., closed) position. The ink 123 may flow from the first inlet 130 or the second inlet 132, through the valve 150 (and the channel 152), and into the internal volume 122 when the valve 150 is in the open position. The ink 123 may be prevented from flowing through this path when the valve 150 is in the closed position. As discussed below, having the valve 150 as part of the reservoir 110A, 110B allows the system to have only one heated assembly (e.g., the reservoir) rather than having two heated assemblies (e.g., the valve and the reservoir).

A tube 154 may extend through each body 120 and into the internal volume 122. As shown, the tube 154 may extend through the lid 128 of the body 120. The tube 154 may be used to introduce air into, or remove air from, the internal volume 122. Air may be introduced into the internal volume 122 through the tube 154 to purge the internal volume 122. Air may be removed from the internal volume 122 through the tube 154 to generate a vacuum effect in the internal volume 122.

One or more heaters (two are shown: 160, 162) may be positioned within each body 120. As shown, the first heater 160 may be positioned within the lid 128 of the body 120. The first heater 160 may positioned adjacent to the first inlet 130, the second inlet 132, the valve 150, or a combination thereof. As such, the first heater 160 may be configured to heat the ink 123 as the ink 123 flows from the first and/or second inlets 130, 132, through the valve 150, and into the internal volume 122. The second heater 162 may be positioned in the base 126 of the body 120. As shown, the second heater 162 may be positioned below the internal volume 122 and between the outlets 142, 144. As such, the second heater 162 may be configured to heat the ink 124 while the ink 124 is in the internal volume 122 and/or while the ink 124 flows through the outlets 142, 144 (e.g., on the way to the printheads 200A-D). The position of the heaters 160, 162 may be varied to maintain the ink 124 within a desired temperature range.

One or more body thermistors 164, 166 may be coupled to and/or positioned within each body 120. The body thermistors 164, 166 may be configured to detect the temperature of the ink 123, 124 and/or to control the heaters 160, 162 to maintain the temperature of the ink 123, 124 within a predetermined range. The first body thermistor 164 may be positioned above the second body thermistor 166. The first body thermistor 164 may control the first heater 160, and the second body thermistor 166 may control the second heater 162.

One or more level sensors (two are shown: 170, 172) may be positioned within each body 120. The level sensors 170, 172 may be configured to detect the level of ink 124 in the internal volume 122. As shown, the first level sensor 170 may be configured to detect when the internal volume is full of ink 124, and the second level sensor 172 may be configured to detect when ink 124 is below a predetermined level in the internal volume 122.

A computing system 180 may be positioned within the printer 100 and be in communication with the valve 150, the heaters 160, 162, the body thermistors 164, 166, the level sensors 170, 172, or a combination thereof. The computing system 180 may actuate the valve 150 from the closed position into the open position when the level sensor 172 indicates that the ink 124 is below a predetermined level in the internal volume 122. The computing system 180 may actuate the valve 150 from the open position into the closed position when the level sensor 170 indicates that the internal volume 122 is full. The computing system 180 may also cause air to be removed from the internal volume 122 through the tube 154, generating a vacuum effect in the internal volume 122. The computing system 180 may also turn the first heater 160 on when the first body thermistor 164 detects that the temperature of the ink 123 has dropped below a threshold value or when the ink 123 is flowing through the inlets 130, 132 and/or the valve 150 and into the internal volume 122. The computing system 180 may also turn the first heater 160 off when the first body thermistor 164 detects that the temperature of the ink 123 is above the threshold value or when the ink 123 is not flowing through the inlets 130, 132 and/or the valve 150 and into the internal volume 122. The computing system 180 may turn the second heater 162 on when the second body thermistor 166 detects that the temperature of the ink 124 has dropped below a threshold value, when the ink 124 is in the internal volume 122, and/or when the ink 124 is flowing through the outlets 142, 144. The computing system 180 may turn the second heater 162 off when the second body thermistor 166 detects that the temperature of the ink 124 is above the threshold value, when the internal volume 122 is empty, and/or when the ink 124 is not flowing through the outlets 142, 144.

Figure 4:
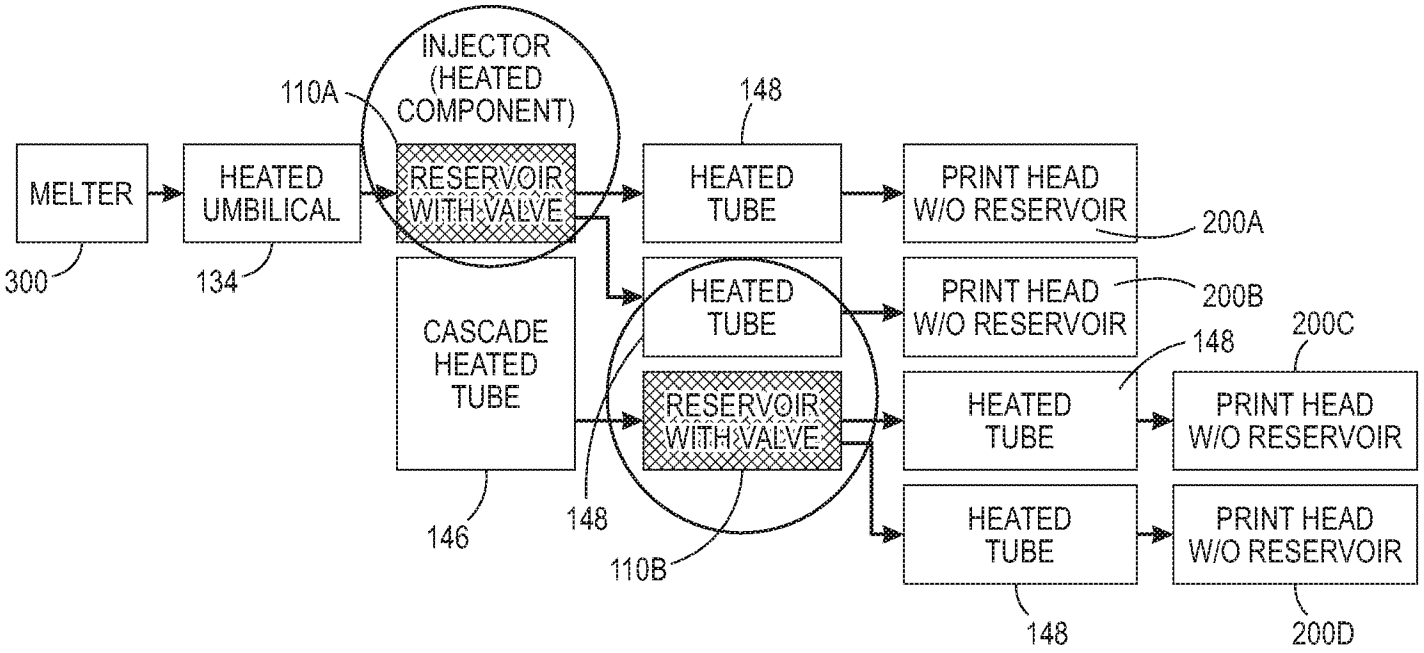
FIG. 4 depicts another schematic view of a portion of the printer, according to an embodiment.

FIG. 4 depicts another schematic view of a portion of the printer 100, according to an embodiment. As shown in FIG. 4, a single heated umbilical 134 may be coupled to and positioned between the melter 300 and the first reservoir 110A. The ink 123 may flow from the melter 300, through the heated umbilical 134, and into the first reservoir 110A. Two (or more) heated tubes 148 may be coupled to and in fluid communication with the first reservoir 110A. The ink 124 may flow from the first reservoir 110A, through the heated tubes 148, and to one or more (e.g., two) printheads 200A, 200B.

A portion of the ink 123 that flows into the first reservoir 110A may flow into the second reservoir 110B. More particularly, the portion of the ink 123 may flow out through the first outlet 140 of the first reservoir 110A rather than into the internal volume 122 of the first reservoir 110A. This portion of the ink 123 may then flow through a heated tube 146 and into the second reservoir 110B via one of the inlets 132 of the second reservoir 110B. Two (or more) heated tubes 148 may be coupled to and in fluid communication with the second reservoir 110B. The ink 124 may flow from the second reservoir 110B, through the heated tubes 148, and to one or more (e.g., two) printheads 200C, D.

Figure 5:
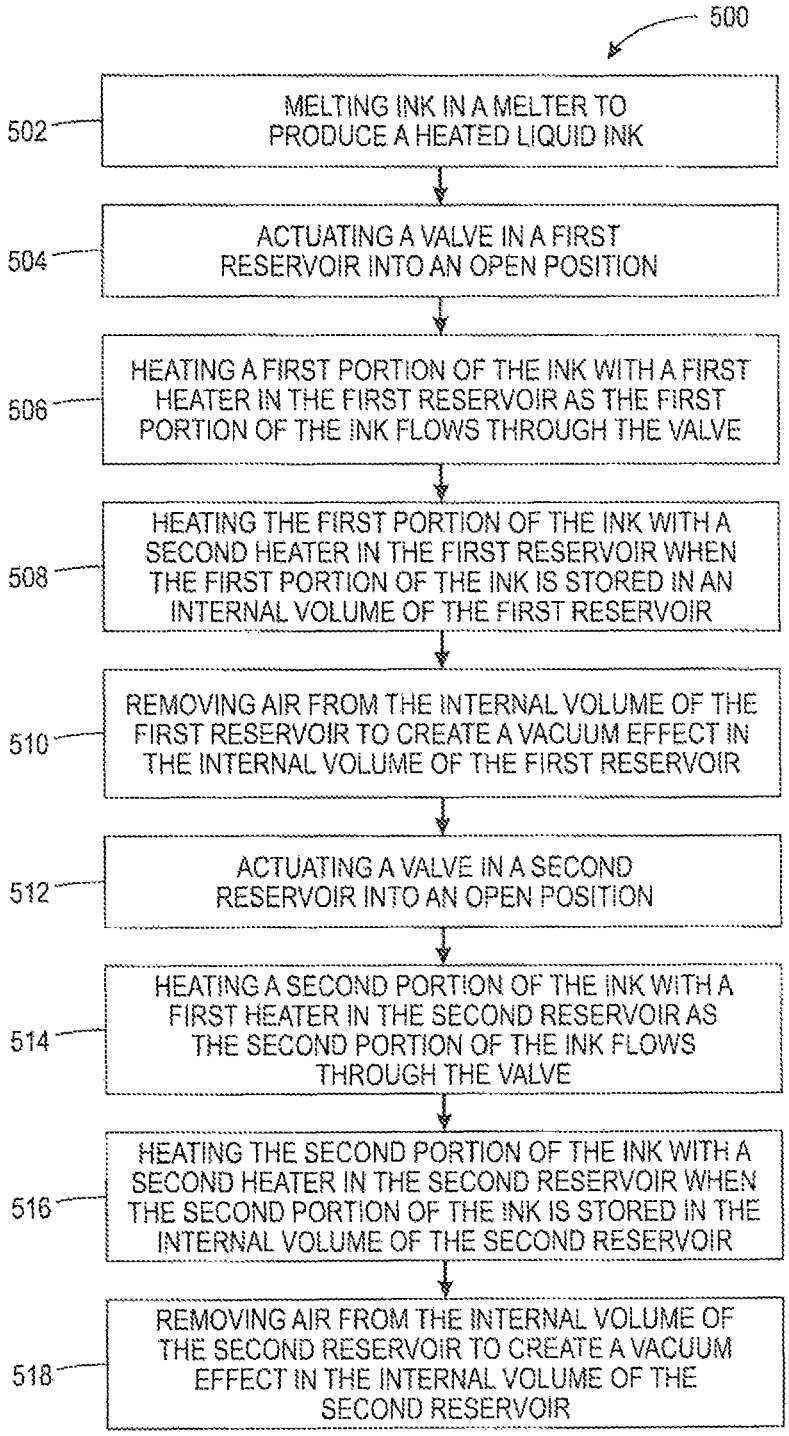
FIG. 5 depicts a flowchart of a method for supplying ink to one or more printheads, according to an embodiment.

FIG. 5 depicts a flowchart of a method 500 for supplying ink 124 to one or more printheads 200A-D, according to an embodiment. The method 500 may include melting ink in a melter 300 to produce a heated liquid ink 123, as at 502. The ink 123, 124 may remain in heated liquid form for the remainder of the method 500. The ink 123 may be pressurized, which may cause the ink 123 to flow from the melter 300 toward an inlet 130 the first reservoir 110A.

The method 500 may also include actuating a valve 150 in the first reservoir 110A into an open position, as at 504. When the valve 150 is open, a first portion of the ink 123 may flow from the inlet 130 of the first reservoir 110A, through the valve 150 of the first reservoir 110A, and into an internal volume 122 of the first reservoir 110A.

The method 500 may also include heating the first portion of the ink 123 with a first heater 160 in the first reservoir 110A as the first portion of the ink 123 flows through the valve 150, as at 506. The method 500 may also include heating the first portion of the ink 124 with a second heater 162 in the first reservoir 110A when the first portion of the ink 124 is stored in the internal volume 122, as at 508.

The method 500 may also include removing air from the internal volume 122 of the first reservoir 110A (e.g., through a tube 154) to create a vacuum effect in the internal volume 122, as at 510. When internal volume 122 of the first reservoir 110A is experiencing the vacuum effect, the ink 124 may flow as needed from the internal volume 122 of the first reservoir 110A, through a first outlet 142, 144 of the first reservoir 110A, through a tube 148, and into one or more first printheads 200A, B.

A second portion of the ink 123 may flow from the first reservoir 110A to a second reservoir 110B (e.g., because the ink 123 is pressurized). More particularly, the second portion of the ink 123 may flow, through a second outlet 140 of the first reservoir 110A, through a tube 146, and into an inlet 134 of the second reservoir 110B.

The method 500 may also include actuating a valve 150 in the second reservoir 110B into an open position, as at 512. When the valve 150 is open, the second portion of the ink 123 may flow from the inlet 130 of the second reservoir 110B, through the valve 150 of the second reservoir 110B, and into an internal volume 122 of the second reservoir 110B.

The method 500 may also include heating the second portion of the ink 123 with a first heater 160 in the second reservoir 110B as the second portion of the ink 123 flows through the valve 150, as at 514. The method 500 may also include heating the second portion of the ink 124 with a second heater 162 in the second reservoir 110B when the second portion of the ink 124 is stored in the internal volume 122 of the second reservoir 110B, as at 516.

The method 500 may also include removing air from the internal volume 122 of the second reservoir 110B (e.g., through a tube 154) to create a vacuum effect in the internal volume 122, as at 518. When internal volume 122 of the second reservoir 110B is experiencing the vacuum effect, the ink 124 may flow as needed from the internal volume 122 of the second reservoir 110B, through a first outlet 142, 144 of the second reservoir 110B, through a tube 148, and into one or more second printheads 200C, D.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" may include any and all sub-ranges between (and including) the minimum value of zero and the maximum value of 10, that is, any and all sub-ranges having a minimum value of equal to or greater than zero and a maximum value of equal to or less than 10, e.g., 1 to 5.

While the present teachings have been illustrated with respect to one or more implementations, alterations and/or modifications may be made to the illustrated examples without departing from the spirit and scope of the appended claims. For example, it may be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It may be appreciated that structural objects and/or processing stages may be added, or existing structural objects and/or processing stages may be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items may be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, the terms "exemplary" or "illustrative" indicate the description is used as an example, rather than implying that it is an ideal. Other embodiments of the present teachings may be apparent to those skilled in the art from consideration of the specification and practice of the disclosure herein. It is intended that the specification and examples be considered as exemplary only, with a true scope and spirit of the present teachings being indicated by the following claims.

What is claimed is:

1. A reservoir in a printer, comprising:
a body comprising:
a lid comprising a first inlet; and
a base comprising a first outlet, wherein the base at least partially defines an internal volume, and wherein the internal volume is positioned between the first inlet and the first outlet;
a valve positioned within the lid, wherein ink flows from the first inlet, through the valve, and into the internal volume when the valve is in an open position, wherein the ink is prevented from flowing through the valve and into the internal volume when the valve is in a closed position, and wherein the ink is configured to flow from the internal volume, through the first outlet, and into a printhead; and
a first heater positioned within the lid, wherein the first heater is configured to heat the ink.

2. The reservoir of claim 1, wherein the valve is on a side of the internal reservoir.

3. The reservoir of claim 1, wherein the lid comprises a second inlet, and wherein a plug is positioned within the second inlet.

4. The reservoir of claim 3, further comprising a second heater positioned within the base, wherein the second heater is configured to heat the ink in the internal volume.

5. The reservoir of claim 4, wherein the base further comprises a second outlet, and wherein the second heater is positioned between the first and second outlets.

6. The reservoir of claim 5, wherein the lid comprises a third outlet, wherein at least a portion of the ink is configured to flow into the reservoir through the first inlet and then out of the reservoir through the third outlet without passing through the valve.

7. The reservoir of claim 6, further comprising a tube having a first end coupled to the third outlet and a second end coupled to an inlet of a second reservoir, wherein the portion of the ink is configured to flow through the tube and into the second reservoir.

8. The reservoir of claim 7, wherein the reservoir is not positioned within the printhead.

9. A solid-ink printer, comprising:
a melter configured to heat an ink to produce a liquid ink;
a first reservoir comprising:
a lid comprising:
a first inlet configured to receive the liquid ink from the melter; and
a first outlet; and
a base comprising a second outlet;
a valve positioned within the first reservoir, wherein a first portion of the liquid ink flows from the first inlet, through the valve, and into an internal volume defined by the base when the valve is in an open position, and wherein the first portion of the liquid ink is prevented from flowing through the valve and into the internal volume when the valve is in a closed position;
a first heater positioned within the lid;
a second reservoir comprising:
a lid comprising:
a first inlet configured receive to a second portion of the liquid ink from the first reservoir, wherein the second portion of the liquid ink flows from the first outlet of the first reservoir, through a tube, and into the first inlet of the second reservoir; and
a first outlet;
a base comprising a second outlet;

a valve positioned within the second reservoir, wherein the second portion of the liquid ink is configured to flow from the first inlet, through the valve, and into an internal volume defined by the base when the valve is in an open position, and wherein the second portion of the liquid ink is prevented from flowing through the valve and into the internal volume when the valve is in a closed position;

a first heater positioned within the lid;

a first printhead, wherein the first portion of the liquid ink is configured to flow from the internal volume of the first reservoir, through the second outlet of the first reservoir, and to the first printhead; and a second printhead, wherein the second portion of the liquid ink is configured to flow from the internal volume of the second reservoir, through the second outlet of the second reservoir, and to the second printhead.

10. The printer of claim 9, wherein the second portion of the liquid ink flows through the first outlet of the first reservoir without passing through the valve in the first reservoir.

11. The printer of claim 9, further comprising a plug positioned in the first outlet of the second reservoir.

12. The printer of claim 9, wherein the base of the first reservoir comprises a second heater.

13. The printer of claim 9, further comprising a level sensor positioned within the internal volume of the first reservoir to detect a level of the first portion of the liquid ink.

14. A method for supplying ink to one or more printheads, comprising:

melting solid ink in a melter to produce liquid ink, wherein the liquid ink flows from the melter into a first reservoir;

actuating a valve in the first reservoir into an open position, allowing a first portion of the liquid ink to flow through the valve of the first reservoir and into an internal volume of the first reservoir, wherein the first portion of the liquid ink then flows from the internal volume of the first reservoir, through a first outlet of the first reservoir, and into a first printhead; and actuating a valve in a second reservoir into an open position, allowing a second portion of the liquid ink to flow out of the first reservoir without passing through the valve of the first reservoir, through a first inlet of the second reservoir, through the valve of the second reservoir, and into an internal volume of the second reservoir, wherein the second portion of the liquid ink then flows from the internal volume of the second reservoir, through a second outlet of the second reservoir, and into a second printhead.

15. The method of claim 14, further comprising removing air from the internal volume of the first reservoir to cause the first portion of the ink to flow into the internal volume of the first reservoir.

16. The method of claim 15, further comprising heating the first portion of the ink with a first heater as the ink flows through the valve of the first reservoir.

17. The method of claim 16, further comprising heating the first portion of the ink with a second heater as the ink is stored in the internal volume of the first reservoir.

* * * * *